United States Patent [19]

Brandewie et al.

[11] 4,354,626

[45] Oct. 19, 1982

[54] APPARATUS FOR FEEDING A PLURALITY OF WIRES

[75] Inventors: Joseph E. Brandewie, Dunedin, Fla.; Walter C. Shatto, Jr., Harrisburg, Pa.

[73] Assignee: AMP Incorporated, Harrisburg, Pa.

[21] Appl. No.: 215,295

[22] Filed: Dec. 11, 1980

[51] Int. Cl.[3] ..... B65H 51/10

[52] U.S. Cl. ..... 226/109; 226/176; 226/186; 226/196

[58] Field of Search ..... 226/109, 110, 108, 176, 226/177, 181, 186, 187, 196

[56] References Cited

U.S. PATENT DOCUMENTS

| | | | |
|---|---|---|---|
| 810,695 | 1/1906 | Backlin et al. | 226/109 |
| 864,860 | 9/1907 | Randall | 226/109 X |
| 2,954,865 | 10/1960 | Hackney et al. | 226/109 X |
| 3,119,536 | 1/1964 | Berkeley | 226/110 |
| 3,239,120 | 3/1966 | Basteels | 226/178 |
| 4,043,494 | 8/1977 | Bickford et al. | 226/109 |

*Primary Examiner*—Stanley N. Gilreath
*Attorney, Agent, or Firm*—F. Brice Faller

[57] ABSTRACT

Wire feeding apparatus comprises pivotal feed wheels on axles which coact with fixed feed wheels on a drive shaft to feed wires therebetween. Each pivotal feed wheel is paired with a pivotal gear which meshes with a fixed gear paired to each fixed feed wheel so that all feed wheels are driven. Auxiliary feed wheels and gears driven by spur gears off the main drive shaft coact with auxiliary pivotal feed wheels and gears to provide a second level of wire feed. Entry wire guides diverge from a single plane to feed the two levels and exit wire guides converge to a single plane from which the wires emerge.

2 Claims, 7 Drawing Figures

11
7
70
70'
20
36'
32'
34'
30'
78'
80'
76
40'
38'
44'
36
32
34
13
30
73'
64'
68'
72
24'
26
80
76
78
38
40
44
62
22'
45'
28'
77'
24
16'
19'
41'
30'
26
62
16
68
22
64
79'
81'
5
73
19
72'
35'
31'
81
77
39
41
79
31
35
71
71'
37'
33'
21
33
37
7
5

APPARATUS FOR FEEDING A PLURALITY OF WIRES

BACKGROUND OF THE INVENTION

The present invention relates to an apparatus for feeding wires to varying predetermined lengths.

There are numerous machines used in the electrical harness making industry which require intermittent feeding of predetermined lengths of wire from an endless source such as a reel or barrel. U.S. Pat. No. 4,043,494 discloses an apparatus for feeding wire in such a manner by utilizing a single wire feed roll driven by a printed circuit motor which coacts with pivotal pressure rolls to drive wires therebetween. The apparatus of U.S. Pat. No. 4,043,494 is directed to achieving high constant levels of both acceleration and deceleration of the feed roll in order to reduce the time to feed a given length of wire and thus permit a higher operating speed of the harness making machinery. A wire clamp is provided which opens at the start of a feeding cycle and closes at the end of the cycle so that feeding is precisely controlled. The clamp and pivotal pressure rolls are mounted on side by side levers which are connected with side by side piston cylinders which move said levers such that each clamp bears on a wire while the respective pressure roll moves out of contact therewith and vice-versa.

In accordance with one aspect of the instant invention, individual fixed feed wheels on a common drive shaft coact with driven pivotal feed wheels which individually move vertically from a coaxial array toward respective fixed feed wheels to grip wires therebetween. Wire control is thus improved over the prior art insofar as driven feed wheels contact the wire being fed on both sides, as opposed to having a driven wheel or roller on one side and an idler on the other. Synchronous rotation is achieved by having a fixed gear on the drive shaft adjacent to each fixed wheel which is never entirely out of mesh with a pivotal gear mounted fixedly with respect to an adjacent pivotal feed wheel. The positive gripping thus achieved improves wire feed performance against a greater wire tension than is possible with a single driven wheel for each wire. The improved gripping achieved by having a driven pivotal wheel for each wire also obviates the need for a clamp, since the wire is positively stopped when coacting wheels stop rotating. In accordance with another aspect of the instant invention, each wire is fed closely between toothed portions of adjacent fixed gears where borne against by coacting fixed and pivotal feed wheels, whereby the fixed gears form part of a wire guide.

In accordance with yet another aspect of the present invention, bifurcated pivot arms carrying pivotal feed wheels at their ends are staggered to opposite sides of the coaxial array of pivotal feed wheels to allow more room for actuators and other linkage associated with the pivot arms, thereby taking best advantage of available space.

Another aspect of the invention is the utilization of a system of auxiliary fixed and pivotal feed wheels driven by spur gears off of the drive shaft and arranged to feed a second level of wires. The second level receives wires through wire guides which diverge vertically from wire guides feeding the first level, all guides having entries in a single plane, whereby a coplanar array of wires can be fed through two feed levels and return to a coplanar array through a similar set of converging guides on the opposite side of the feed wheels.

It is thus an object of the present invention to provide an improved wire feeding apparatus which may be used in conjunction with harness making equipment or mass terminating equipment. An object is to provide improved wire gripping during feed to effect precise control of lengths of wire being fed. An object is to take maximum advantage of space limitations so that a large number of wires may be fed.

The accomplishment of these and other objects will be apparent from the description of the preferred embodiment which follows, with reference to the accompanying drawings.

BRIEF DESCRIPTION OF THE DRAWINGS

FIG. 3 is a perspective of the gear train and feed wheels.

DETAILED DESCRIPTION OF THE PREFERRED EMBODIMENT

Figure 1:
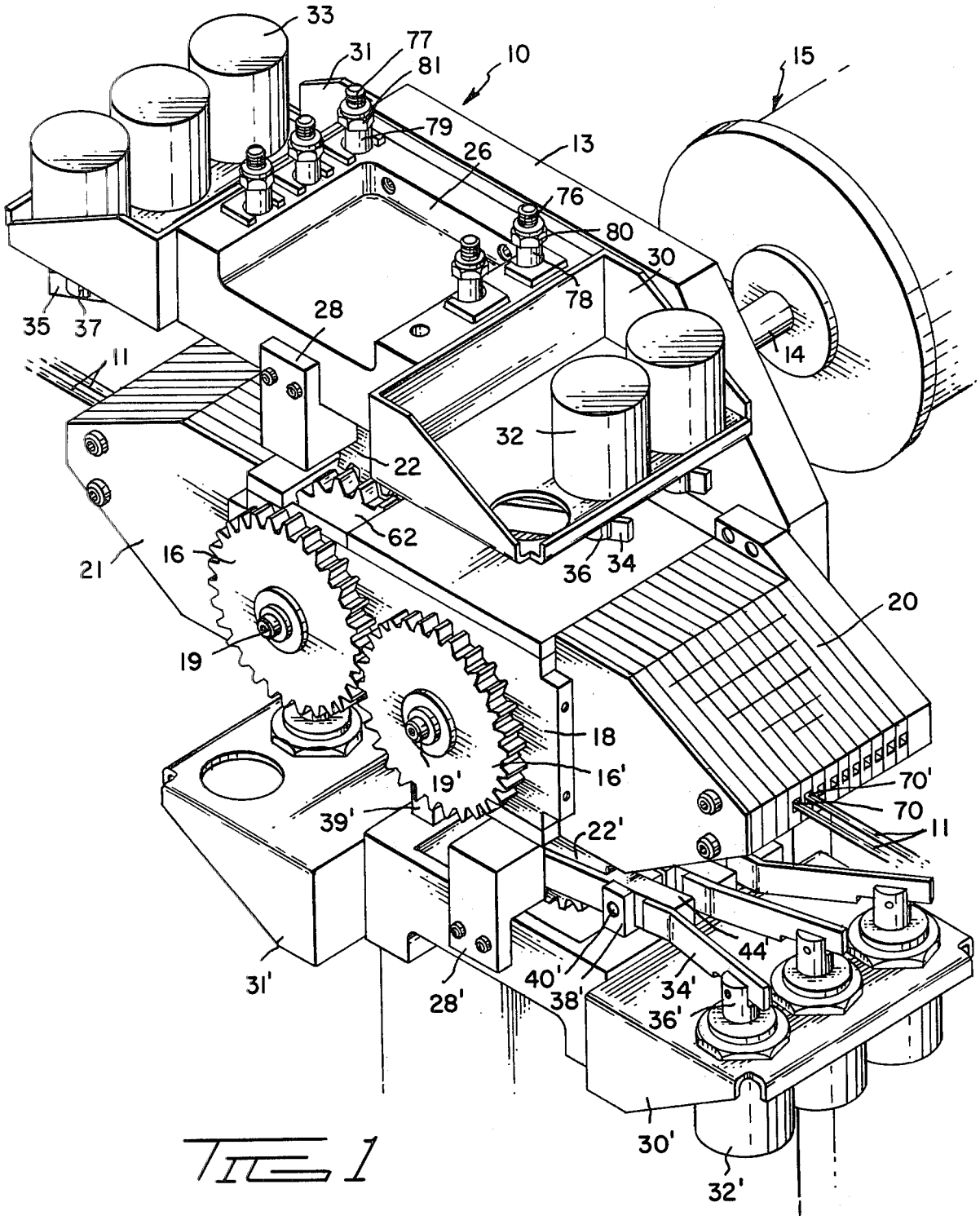
FIG. 1 is a perspective of the wire feeder.

The wire feeding apparatus of the present invention comprises a wire feeder, a drive motor, and a controller. FIG. 1 shows an embodiment of the wire feeder 10 and the motor 15; the controller is an electrically connected remote unit. Wires 11 are individually drawn into tunnels or entry guides 70, 70' in diverging wire guide assembly 20 and are fed through to emerge from converging wire guide assembly 21 at the other end in lengths which are predetermined by the programmed controller. Components of the wire feeder 10 are mounted to the back plate 13. A fixed feed wheel housing 18 houses main drive shaft 14 (not visible) which carries a spur gear 16 outside the housing by means of screw 19; spur gear 16 drives auxiliary spur gear 16' carried by auxiliary drive shaft 14' (not visible) by means of screw 19'. Pivotal feed gears 22 and pivotal feed wheels 24 (not visible) are carried by pivot arms 34, 35 in pivotal feed roll housing 26 to which solenoid mounts 30, 31 bearing solenoids 32, 33 are attached. The solenoids 32, 33 act on the opposite ends of the pivot arm straps 34, 35 via pivot arm yokes 36, 37 to pivot the bifurcated pivot arms 44, 45 which carry the feed gears 22 and feed wheels 24 about fulcrum pins 40, 41 (not visible) carried in fulcrum yokes 38, 39 (not visible). Note that even numbers 30, 32, 34, 36, 38, 40 refer to components right of pivotal gears 22 while odd numbers 31, 33, 35, 37, 39, 41 refer to components left of the pivotal gears 22. Prime numbers refer to similar components below the feed roll housing; components bearing prime numbers should be referred to where similar components above the feed roll housing are not visible.

The apparatus of the embodiment illustrated herein can feed 10 wires, but may be readily modified to feed 12 wires by the provision of an additional solenoid 32 in solenoid mount 30 and by provision of an additional auxiliary solenoid 33' in mount 31'. Additional pivotal wheels and linkage and fixed wheels and linkage would be added as will be explained.

Figure 2:
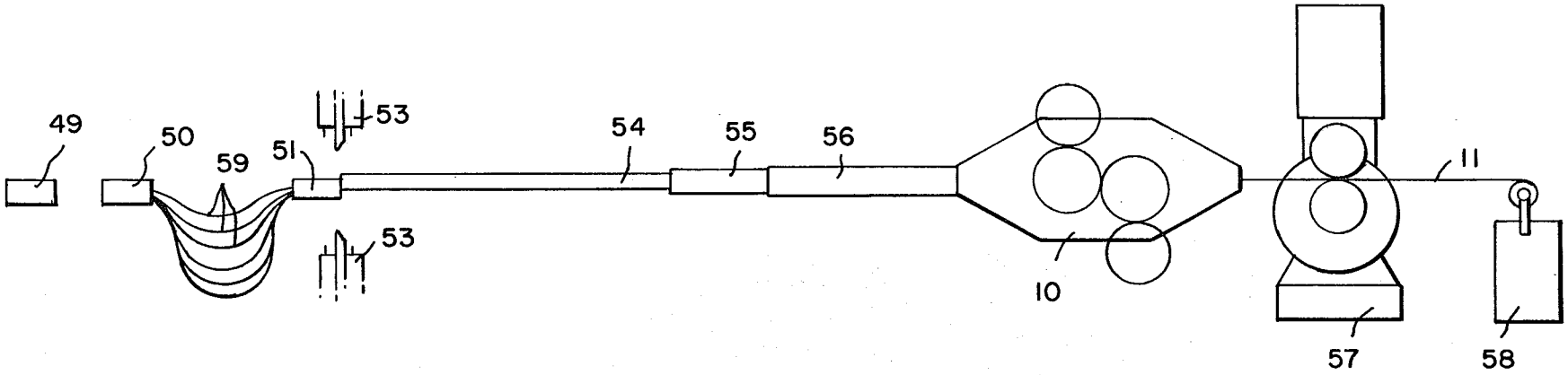
FIG. 2 is a diagrammatic elevation of the subject apparatus as employed with a cable maker.

FIG. 2 depicts the wire feeder 10 as used in conjunction with a cable making apparatus of the general type described in U.S. patent application Ser. No. 176,812; the wires 11 originate in wire barrels 58 and pass through a loop pull back device 57, the wire feeder 10, a collapsing wire guide 56, a horizontal converger 55 which is mounted on telescoping shuttle 54, past grippers 51 and into a connector at the insertion station 50. The operation is shown subsequent to terminating leading ends of the wires 11 at terminating station 49 and subsequent to loading into a connector housing at the loading station 50. The function of loop pull back device 57 is to keep the wires taut while the shuttle retreats between terminating and loading. The shuttle 54 is shown in the position in which the wires are fed, during which time the pull back device 57 is in an open position while the wire unravels readily from individual wire barrels 58. The collapsing wire guide 56 prevents buckling of wires fed therethrough and the horizontal converger 55 modifies the centerline spacing from that in the feeder 10 to that in the shuttle 54. Wires are payed out to different lengths as shown, then gripped by grippers 51 as shown while the shuttle retreats and the cut and strip device 53 cuts and strips the wires. During retreat, the collapsing wire guide 56 collapses while the wires remain stationary. Subsequent to cutting and stripping, grippers 51 release the trailing ends of the wires, and the connector housing is removed from the insertion station. This may be accomplished by a manual slide as shown in Ser. No. 176,812, or, in a more automated version, on a conveyor belt.

FIG. 3 shows the gear train isolated from the housing and other linkage. The drive shaft 14 carries fixed feed gears 62 and fixed feed wheels 64 inside housing 18 (FIG. 1). The pivotal feed wheels 24 have the same width as the fixed feed wheels 64 and are situated directly thereabove. Pivotal feed gears 22 abut respective adjacent pivotal feed rolls 24 and are narrower than fixed feed gears 62, thereby creating gaps above portions of each fixed gear 62 as will be more readily apparent in FIG. 5. The pivotal gears 22 and fixed gears 62 are shown in a partially meshed position, which corresponds to a non-feeding position for the feed wheels 24, 64. When fully meshed, the feed wheels are in a feeding position and spaced to accommodate a wire 11 therebetween. Spur gears 16, 16' are always fully meshed and auxiliary drive shaft 14' is thus axially stationary with respect to main drive shaft 14. The spur gears are sufficiently larger than the fixed gears 62 and auxiliary fixed gears 62' so that there is no interference among the fixed gears 62, 62'. Wires are fed on two levels of five each between the fixed and pivotal feed wheels 64, 24 on the upper level and the auxiliary fixed and auxiliary pivotal feed wheels 64', 24' on the lower level. Auxiliary wheels 24', 64' and gears 22', 62' are arranged similarly to wheels 24, 64 and gears 22, 62. Note that the main drive shaft turns counterclockwise so that all wires move right to left. The circumferential surfaces of the feed wheels are reeded or knurled to aid in gripping the insulation on the wires during feeding. Alternative schemes for aiding wire gripping at the circumferential surface include surrounding the feed wheels with rubber tires or coating the surfaces with a tacky substance.

Figure 4:
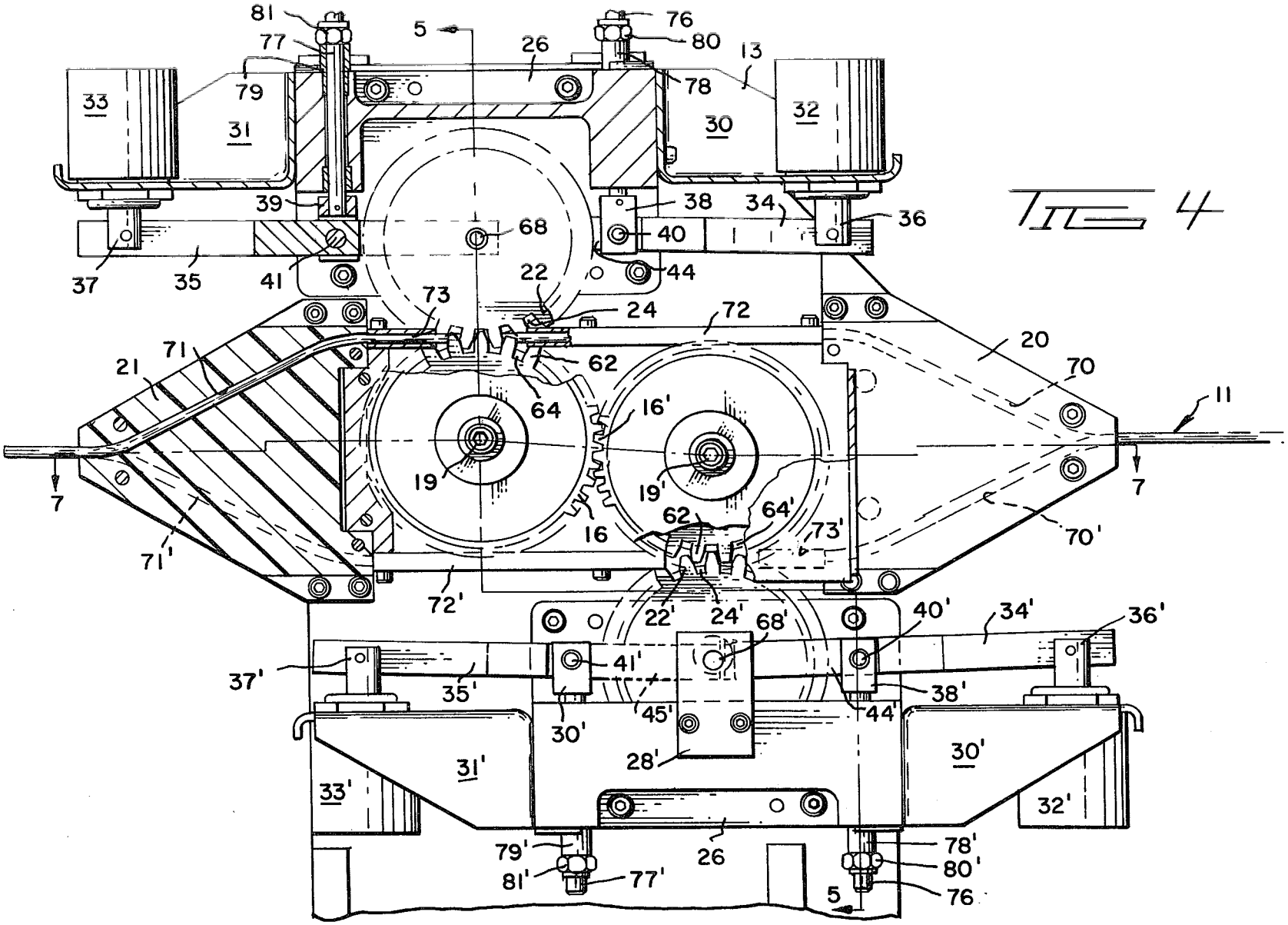
FIG. 4 is a partially cutaway side view of the wire feeder.

FIG. 4 is a side cutaway which shows an upper pivotal gear 22 fully engaged to the corresponding fixed feed gear 62, so that adjacent pivotal and fixed feed wheels 64, 24 are in the feeding position. When the feed wheels are in the feeding position, their circumferential surfaces are tangent to a wire passing through tunnels or guides in the apparatus. This is theoretically a point contact but is actually linear due to flexibility of wire insulation. Use of a rubber tire as mentioned further increases the contact surface. Where space limitations are not critical an apparatus utilizing larger gears and wheels would also increase the contact surface. Referring first to wire paths to and from the five fixed feed wheels 64 and the five pivotal feed wheels 24, five upper entry guides 70 enter the diverging wire guide assembly where they diverge from the five lower entry guides 70'. The entry guides 70, 70' alternate so that of a planar array of ten wires, every other one will seek the same level. Upper entry guides 70 are continuous with long guide 72 which opens directly between the feed wheels 24, 64 where the wire is gripped normally and fed into short guide 73, which is continuous with upper exit guide 71 in converging wire guide assembly 21, where wires from the two levels are again brought into a single planar array. Wires are fed through the auxiliary fixed and pivotal feed wheels 64', 24' by passing through lower entry guides 70', short guide 73', long guide 72', and lower exit guide 71'. Note that the axis of the main drive shaft 14 is higher than the axis of the auxiliary drive shaft 14', by a distance slightly greater than the diameter of guides 72, 72' which pass adjacent to auxiliary fixed feed gears 62' and fixed feed gears 62 respectively. This permits feed paths in the upper and lower levels to be parallel and still present the wires directly between the respective feed wheels, so that directly opposed points on the circumferential surfaces of the fixed and pivotal wheels will grip the wire. This guide/wheel arrangement also takes maximum advantage of space limitations, and will be further discussed with reference to FIGS. 5, 6, and 7.

Referring still to FIG. 4, movement of the pivotal feed wheels 24 between the non-feeding and the feed positions will be discussed. Each pivotal feed wheel 24 is carried by a discrete axle 68 which also carries a single pivotal feed gear 22. The gear 22 and wheel 24 are against each other and have the axle 68 protruding from either side thereof which is carried by a bifurcated pivot arm 44 or 45. Pivot arms 44 on the right, carry alternate pivotal gears from pivot arms 45, on the left, as will be more readily apparent in FIG. 7. To engage the gears 22, 62 so that corresponding wheels 24, 64 are in the feeding position, solenoid 33 is actuated, which draws pivot arm yoke 37 and strap 35 upward which causes arm 45 to pivot about fulcrum pin 41, thus causing the pivotal gear 22 to fully engage fixed gear 62. The fulcrum pin 41 is carried by fulcrum yoke 37 which is carried on the end of fulcrum shaft 77, the height of which is adjustable so that the travel of gear 22 and wheel 24 may be adjusted. Pivot arms 34 pivot similarly about fulcrum pins 40, and the auxiliary pivot arms 44', 45' are similarly linked between solenoids 32', 33' and auxiliary feed gears 22'.

Figure 5:
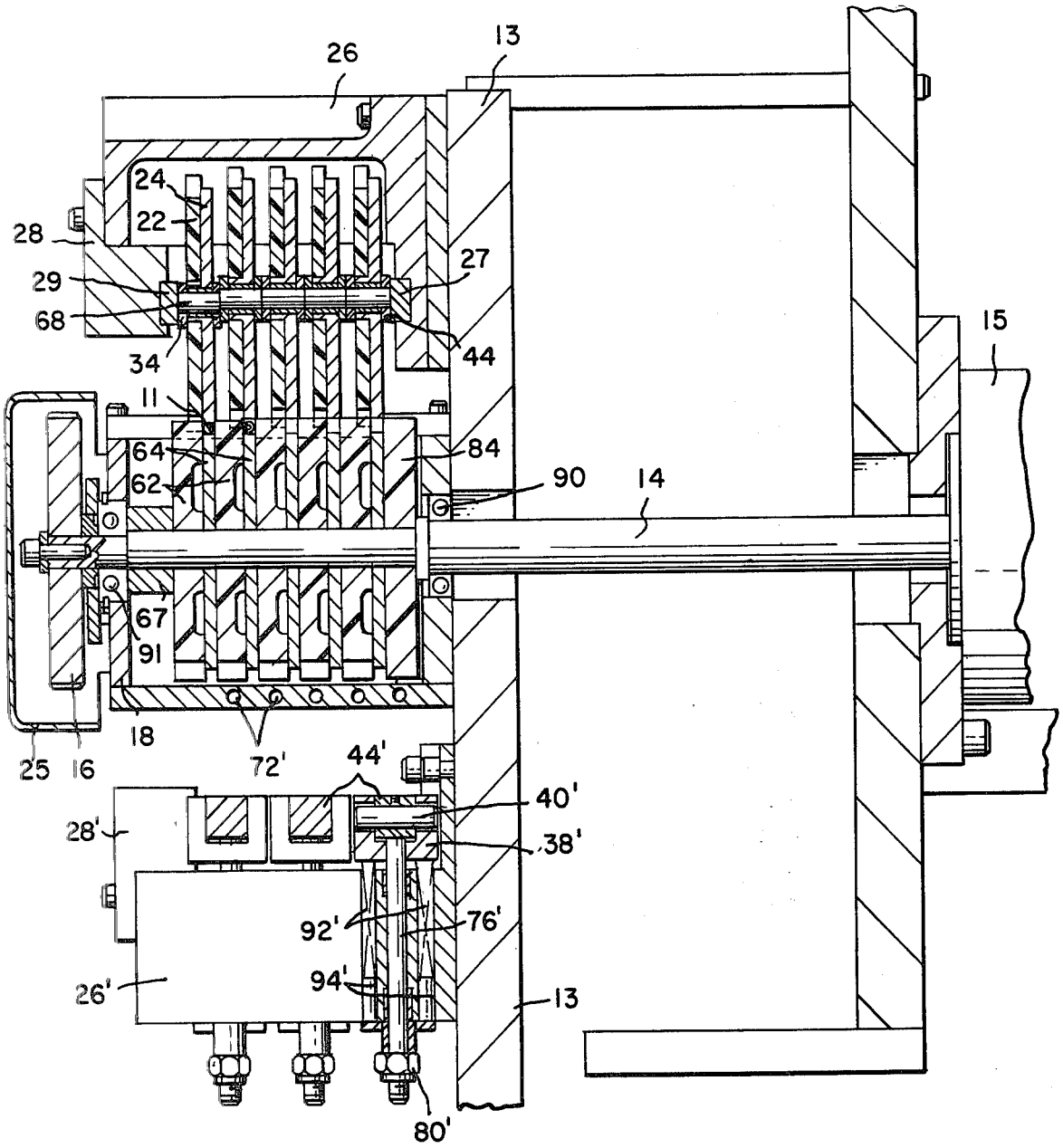
FIG. 5 is an end sectional view of the wire feeder, taken along line 5—5 of FIG. 4.

FIG. 5 shows the relationship of fixed gears 62 and feed wheels 64 to pivotal gears 22 and pivotal feed wheels 24. Here it is apparent that the pivotal gears 22 are thinner than the fixed gears 62, so that the bifurcated pivot arms 44 can carry the discrete axles 68 with the pivotal feed wheels 24 directly above the fixed feed wheels 64. Further, since the fixed feed gears 62 are wide enough to abut the feed wheels 64 on both sides, the wire 11 is trapped between the gears 62 which thus act as a wire guide. The fixed feed gear 62 on the right end is abutted by a spacer disc 84 which in conjunction with spacer 67 positions the gears 62 and wheels 64 on the drive shaft 14, which is carried in the fixed feed wheel housing 18 by ball bearings 90, 91. The pivotal gears 22 and feed wheels 24 are carried on axles 68 which are aligned in housing 26 by alignment pads 27, 29; pad 29 is carried by alignment pad block 28 which is bolted to housing 26. An additional axle 68 carrying an additional pivotal gear 22 and wheel 24 may be accommodated by use of a differently sized alignment pad block 28, which may be readily machined. An additional feed gear 62 and wheel 64 could be accommodated by providing a smaller spacer 67. All feed wheels and gears are fixed to their respective drive shaft or axles by keys so that they may readily be replaced. The left-most pivotal gear 22 is shown fully engaged with the fixed gear 62 immediately below so that the adjacent wire feed wheels 24, 64 are in the feeding position. This corresponds with the position shown in FIG. 4. A cover 25 is mounted to housing 18 over spur gears 16, 16'.

FIG. 5 also details the structure of the fulcrum shafts 76' and associated linkage; these are arranged similarly to the other fulcrum shafts 76, 77, 77' elsewhere in the apparatus and the following description is therefore exemplary. Fulcrum pins 40' are carried in fulcrum yokes 38' which are fixed to the upper ends of fulcrum shafts 76'. The lower ends of the shafts 76' are threaded and have adjusting nuts 80' thereon which control the height of the yokes 38' and pins 40'. A pair of springs 92' situated in bores in the auxiliary pivotal feed roll housing 26' on either side of shaft 76' bear against yoke 38' at the upper end and spacers 94' at the lower end to maintain the fulcrum pin height determined by the adjusting nuts. A small space exists between the yoke 38' and the housing 26', which allows for adjustment and further provides some resiliency to the pivot arm 44' to prevent the auxiliary pivotal feed wheel 24' from exerting an undue normal force on the wire if adjustment is not precise. Note that while the adjustment feature of the fulcrum shafts is primarily for determining height, if also aids in adjusting normal force on wires which vary slightly in size. If substantially larger wires are fed, the wheels should be changed in favor of smaller wheels to ensure that the gears are fully meshed when the wheels grip the wires in the feed position. Otherwise, backlash in the gears would result. If substantially smaller wires are fed, the gears could be fully meshed while the wheels would not grip the wires with sufficient force for feeding, or the gears could overmesh. The adjustment ensures the proper travel of gear 22' and wheel 24' when the solenoid is fully actuated, as it must be to prevent electrical damage. The normal force on the wires is determined primarily by the spring constant of the springs 92, 92' and the size of spacers 94, 94' used to preload the springs against the pivot arm yokes.

Figure 6:
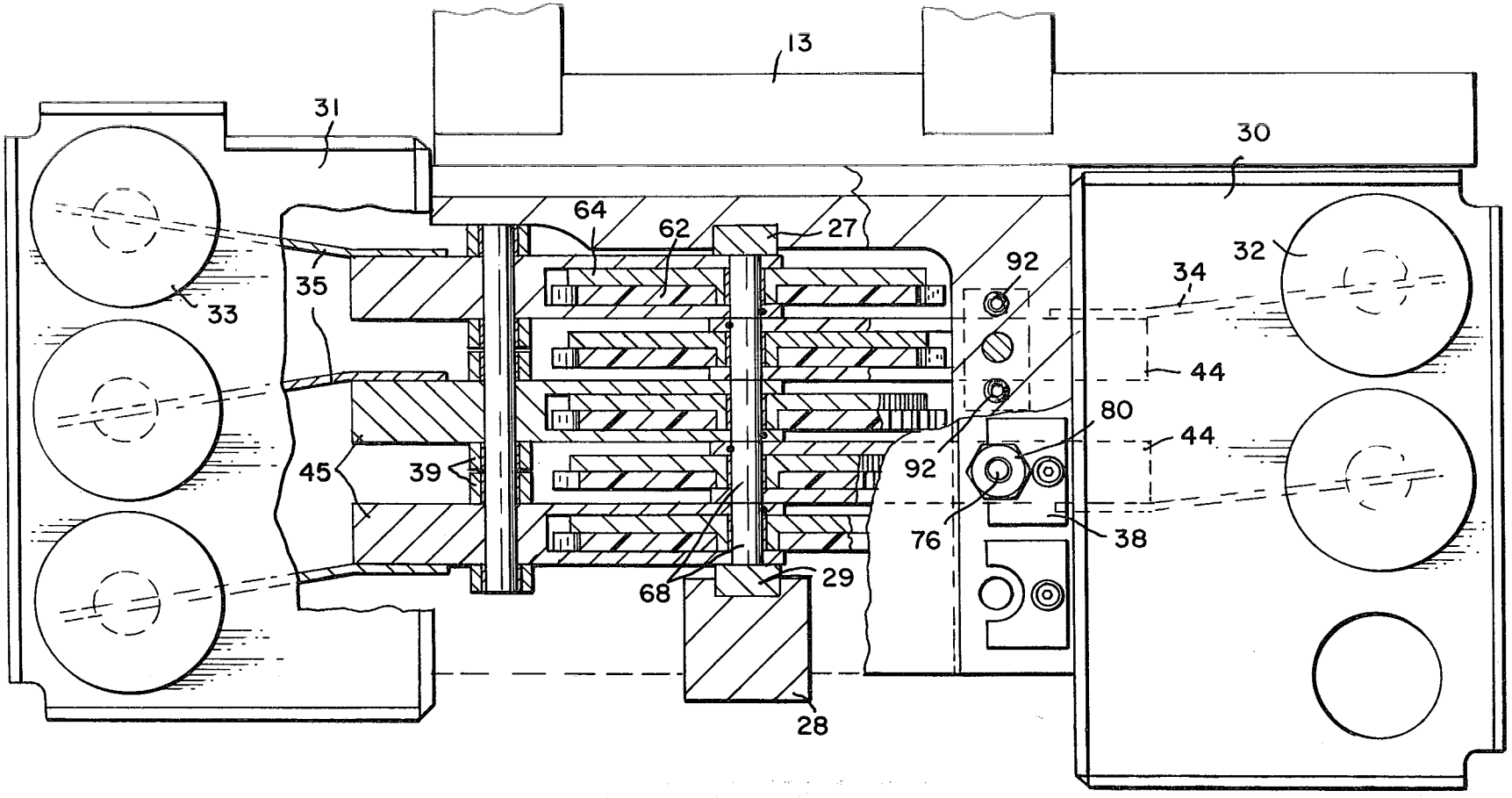
FIG. 6 is a top cutaway of the wire feeder.
Figure 7:
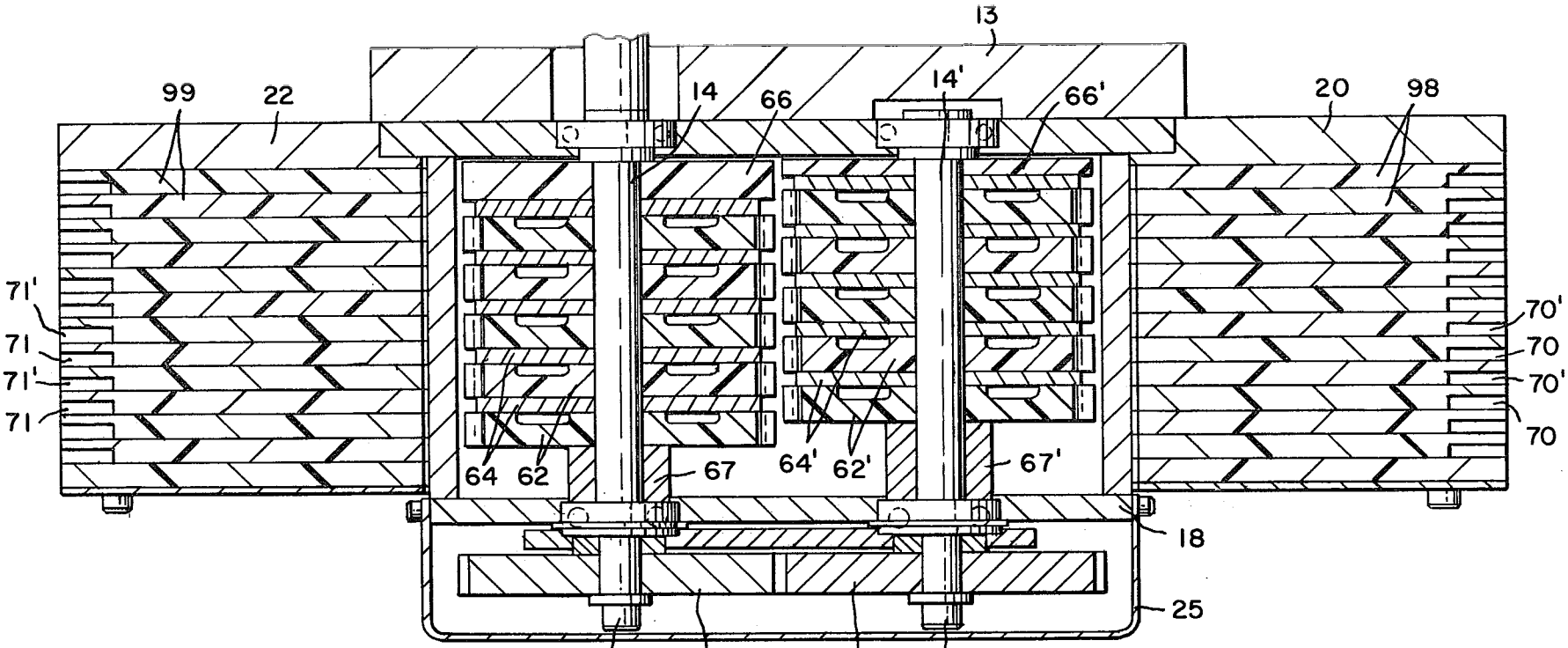

FIG. 6 is a top cutaway view of the wire feeder which further illustrates the pivotal feed wheel linkage. Note that alternate axles 68 are carried by pivot arms 44 while the remaining axles are carried by arms 45 on the other side. This permits the fulcrum yokes 38 and 39 to occupy a wider space than the axles 68, which would not be possible if all pivot arms and pivot arm straps on the same level were side by side. Thus, the staggered pivot arm arrangement, in combination with the dual-level wire feed, permits a compact design of the wire feeder so that it may readily be used in conjunction with other machinery such as the modular cable maker illustrated diagrammatically in FIG. 2.

Figure 7:
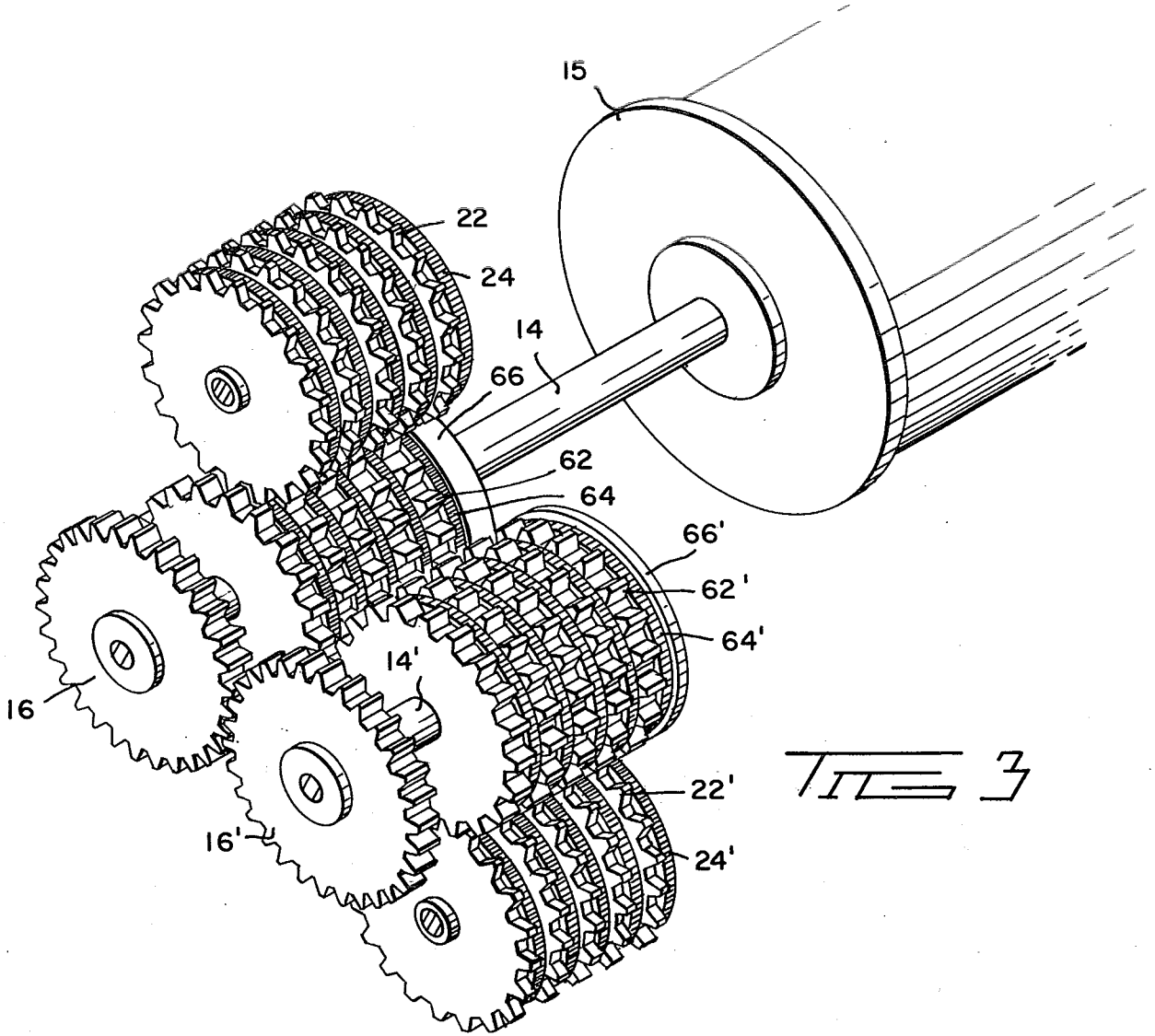
FIG. 7 is a section of the wire feeder, taken along line 7—7 of FIG. 4.

FIG. 7 is a cross section taken through the wire guide assemblies 20, 21 along line 7—7 of FIG. 4. The guide assemblies 20, 21 are comprised of laminas 98, 99 respectively in which guide channels in the form of the upper entry and exit guides 70, 71 and lower entry and exit guides 70', 71' have been cut prior to sandwiching the laminas together to form the guide assemblies. All lamina are constructed of an ultra high molecular weight (UHMW) polymer such as polyethylene which has a very low coefficient of friction to reduce drag on the wires, and very good resistance to wear. Upper entry guides 70 in alternate laminas 98 of the diverging wire guide assembly 20 and upper exit guides 71 in alternate laminas 99 of the converging wire guide assembly 21 are aligned with fixed feed wheels 64 while lower guides 70', 71' are aligned with auxiliary fixed feed wheels 64'. Spacers 66, 67 serve to position the fixed gears 62 and wheels 64 on the main drive shaft 14 in proper alignment with the upper wire guides while spacers 66', 67' serve to position the auxiliary fixed gears 62' and wheels 64' on shaft 14'. The laminas 98 shown without entry guides 70, 70' and the laminas 99 shown without exit guides 71, 71' could readily be replaced by laminas with guides cut therein, if additional wire feeding capacity were desired. Recalling FIG. 4, long guides 72, 72' and short guides 73, 73' serve to complete the wire paths between the laminated guide assemblies 20, 21.

The operation of the wire feeding apparatus will now be described. Its function in the context of a cable maker has already been described in conjunction with FIG. 2; different lengths of wires are drawn by the fixed feed wheels and coacting pivotal feed wheels to lengths as determined by a programmed controller. In order to be fed, wires must first lie in the guides so that they pass between the fixed and coacting pivotal wheels. Assume that ten wires are to be fed, though any number up to ten could be fed by the apparatus as shown. Wires are supplied from ten individual take-up barrels to eliminate the inertial effects of pulling wire off of spools. When wires are not being fed, the fixed and pivotal gears are only partially meshed and the pivotal feed wheels are thus in the non-feeding position, where they exert no normal force on the wires. The first step is to feed all ten wires to the length of what is to be the shortest wire in the group. This is accomplished by actuating all ten solenoids so that all pivotal feed wheels are in the feeding position; the motor is then energized for a number of revolutions determined by the controller, which thus determines the length of wire fed. The number of revolutions may be controlled to 0.005 revolution, as 200 electronic pulses are required for one revolution. The solenoid controlling the pivotal feed wheel (or wheels) engaging what is to be the shortest wire or (wires) in the group is de-activated after the drive motor is de-energized, and the motor is subsequently energized until the remaining 9 (or fewer) wires reach the length of the second shortest wire (or wires) in the group. The process is repeated until only the solenoids controlling the longest wires in the group remain actuated; following this feeding step, the wires are cut and removed. According to this operating procedure, if ten wires are to be fed to ten different lengths, the longest will undergo ten incremental feeding steps. The programming and operation of the motor and solenoids of the present invention are quite similar to that described in U.S. Pat.

No. 4,043,494, the specification and drawings of which are hereby incorporated by reference. FIGS. 8 through 10 of that patent are particularly helpful in understanding the wire feed in the present invention.

An important feature of the invention is its simplicity. Many of the parts are identical to other parts, for example, the feed wheels, solenoids, and associated linkage for any given wire may be readily interchanged with the like component used to feed any other wire. The straps connecting each pivot arm to its actuating solenoid are bent slightly differently, but art otherwise identical. The fixed gears are of different thickness than the pivotal gears but the fixed and pivotal feed wheels are the same. Note, however, that different sized feed wheels may be used to simultaneously feed different sized wires.

A related goal achieved by the invention is ease of dismantling and reassembly. The wire guides 70, 70', 71, 71' as well as long guides 72, 72' and short guides 73, 73' may accumulate residue from the wires passing therethrough, and should in that event be taken out and cleaned periodically.

The foregoing description is directed to a 12 wire apparatus set up for 10 wires, but the principles involved apply to feeding any number of wires by use of modified support members and additional wheels, gears, solenoids, and associated linkage. An apparatus using considerably larger wheels could be built to provide greater wire contact area where space is not a primary consideration. The description is exemplary and not intended to limit the scope of the claims which follow.

What is claimed is:

1. Wire feeding apparatus comprising:

wire feed means operative to feed a first plurality of wires on a first level and a second plurality of wires on a second level, said first plurality of wires passing through first parallel planes which are perpendicular to said first level, said second plurality of wires passing through second parallel planes which are perpendicular to said second level, said first planes being parallel to and alternate with said second planes, guide means operative to distribute said first and second pluralities of wires to said first and second levels from a single planar array, said guide means comprising laminas in said first and second parallel planes, each lamina having a guide channel cut in one surface thereof, alternate laminas having guide channels directed to said first level while remaining laminas have guide channels directed to said second level, said laminas being sandwiched together so that each guide channel is enclosed by the adjacent lamina to form a tunnel.

2. Wire feeding apparatus comprising:

a plurality of fixed wire feed wheels fixedly mounted on a main drive shaft, each said fixed feed wheel having a circumferential wire engaging surface, a like plurality of fixed gears fixedly mounted on said main drive shaft, said gears occupying positions adjacent and alternate to said fixed wire feed wheels, all said fixed gears being of the same diameter, which diameter is slightly larger than the diameter of said fixed wire feed wheels, a like plurality of pivotal wire feed wheels on discrete axles parallel to said main drive shaft, each said pivotal wire feed wheel being coplanar with a single coacting fixed wire feed wheel and having the same diameter as the coacting fixed wire feed wheel, each of said pivotal feed wheels having a nonfeeding position in which it is spaced from the respective coacting fixed feed roll and being individually movable toward said fixed feed wheel to a wire feeding position, said axles being colinear when all said pivotal wheels are in the nonfeeding position, a like plurality of pivotal gears, each said gear being mounted on one of said discrete axles, each said axle carrying a single pivotal wire feed wheel and a single adjacent pivotal gear, each said pivotal gear being coplanar with a single coacting fixed gear and having the same diameter and tooth profile as the fixed gears, said pivotal gears being partially meshed with said coacting fixed gears when adjacent pivotal feed rolls are in said nonfeeding position and fully meshed when adjacent pivotal feed rolls are in said feeding position, guide means for guiding a like plurality of wires tangentially toward said fixed feed wheels and positioning one wire between each pivotal feed wheel and the coacting fixed feed wheel, an auxiliary drive shaft which parallels said main drive shaft, said main drive shaft carrying a spur gear fixedly mounted thereto, said spur gear being larger than said fixed gears, said spur gear meshing with a coplanar auxiliary spur gear mounted fixedly to said auxiliary drive shaft, said auxiliary spur gear being of the same size as said spur gear so that the rotation of the main and auxiliary drive shafts will be synchronous, a plurality of auxiliary fixed wire feed wheels and auxiliary fixed gears on said auxiliary drive shaft arranged as said fixed wire feed wheels and fixed gears on said drive shaft, said auxiliary fixed gears being the same size as said fixed gears, a like plurality of auxiliary pivotal feed wheels and auxiliary pivotal gears arranged as said pivotal feed wheels and pivotal gears, said auxiliary pivotal feed wheels and auxiliary pivotal gears coacting with said auxiliary fixed feed wheels and auxiliary fixed gears in the manner in which said pivotal feed wheels and pivotal gears coact with said fixed feed wheels and fixed gears, auxiliary guide means for guiding wires tangentially toward said auxiliary fixed feed wheels and positioning one wire between each auxiliary pivotal feed wheel and the coacting auxiliary fixed feed wheel, planes defined by the fixed feed wheels alternating with the parallel planes defined by the auxiliary feed wheels, said guide means to the fixed feed wheels comprising tunnels in the planes of the fixed feed wheels, said auxiliary guide means comprising tunnels in the planes of the auxiliary feed wheels, all of said tunnels converging into a single plane remote from said wheels, whereby the wires being fed may enter the apparatus in a coplanar array.

* * * * *